United States Patent [19]

Hamisch, Jr. et al.

[11] Patent Number: 4,957,379

[45] Date of Patent: Sep. 18, 1990

[54] PRINTING APPARATUS

[75] Inventors: Paul H. Hamisch, Jr., Franklin; David R. Wisecup, Xenia, both of Ohio

[73] Assignee: Monarch Marking Systems, Inc., Dayton, Ohio

[21] Appl. No.: 296,171

[22] Filed: Jan. 11, 1989

[51] Int. Cl.[5] ..... B41J 2/315; B41J 2/32

[52] U.S. Cl. ..... 400/120; 101/288

[58] Field of Search ..... 101/288; 400/120, 356

[56] References Cited

U.S. PATENT DOCUMENTS

| | | | |
|---|---|---|---|
| 2,107,997 | 2/1938 | Horsley | 220/41 |
| 4,013,159 | 3/1977 | Okake | 400/120 |
| 4,061,227 | 12/1977 | Olbres | 206/454 |
| 4,162,024 | 7/1979 | Shanley | 230/350 |
| 4,222,673 | 9/1980 | Plaza et al. | 400/57 |
| 4,391,535 | 7/1983 | Palmer | 400/120 |
| 4,465,187 | 8/1984 | Kinard | 206/425 |
| 4,490,206 | 12/1984 | Makley | 156/384 |
| 4,493,566 | 1/1985 | McMahon et al. | 400/55 |
| 4,555,715 | 11/1985 | Vegeais et al. | 400/120 |
| 4,560,292 | 12/1985 | Takahashi | 400/120 |
| 4,685,815 | 8/1987 | Baranyi | 400/120 |
| 4,704,619 | 11/1987 | Bierhoff et al. | 400/120 |
| 4,750,880 | 6/1988 | Stephenson et al. | 400/120 |
| 4,775,870 | 10/1988 | Grimm et al. | 400/120 |
| 4,776,714 | 10/1988 | Sugiura et al. | 400/248 |
| 4,787,759 | 11/1988 | Geis et al. | 400/55 |
| 4,830,523 | 5/1989 | Sparer et al. | 400/120 |

FOREIGN PATENT DOCUMENTS

| | | | |
|---|---|---|---|
| 134286 | 6/1986 | Japan | 400/621 |

*Primary Examiner*—Edgar S. Burr
*Assistant Examiner*—Joseph R. Keating
*Attorney, Agent, or Firm*—Joseph J. Grass

[57] ABSTRACT

There is disclosed a printing apparatus for printing on tags and labels. The apparatus includes a compact housing which is comprised essentially of plastics material. The housing includes a self-storing sliding cover, end plates and a base forming track structure for the cover, and a shelf for mounting a thermal printing mechanism. The printing mechanism is a compact module that is suitably secured in the housing. The printing mechanism includes structure for maintaining tension in a label-carrying web, for adjusting the orientation of the printing mechanism's thermal print head, and for applying controlled rewinding.

11 Claims, 10 Drawing Sheets

PRINTING APPARATUS

BACKGROUND OF THE INVENTION

1. Field of the Invention

This invention relates to the art of printing on record members such as tags and labels.

2. Background of the Prior Art

The following prior art United States patents are made of record: U.S. Pat. No. 2,107,997 to Horsley granted Feb. 8, 1938; U.S. Pat. No. 4,061,227 to Olbres granted Dec. 6, 1977; U.S. Pat. No. 4,162,024 to Shanley granted July 24, 1979; U.S. Pat. No. 4,391,535 to Palmer granted July 5, 1983; U.S. Pat. No. 4,465,187 to Kinard et al granted Aug. 14, 1984; U.S. Pat. No. 4,490,206 to James A. Makley granted Dec. 25, 1984; and U.S. Pat. No. 4,776,714 to Sugiura et al granted Oct. 11, 1988.

SUMMARY OF THE INVENTION

It is an object of the invention to provide an improved printing apparatus having a platen roll and a thermal print head cooperable with the platen roll for printing on labels on a carrier web, a delaminator, an arrangement for maintaining the tension in the carrier web at the delaminating means, and wherein the tension is maintained by a driven tensioning roll having a higher peripheral speed than the platen roll.

It is another object of the invention to provide an improved printing apparatus including a cooperating print head and platen for printing on labels on a carrier web, a delaminator, a carrier web tensioning device downstream of the delaminator, and a carrier web rewinder downstream of the tensioning device.

It is yet another object of the invention to provide an improved thermal printing apparatus, wherein the print head is pivotally mounted about a first axis by a mounting member, and wherein the mounting member is pivotally mounted about a second axis with respect to the first axis.

It is another object of the invention to provide an improved printing apparatus in which a thermal print head has a straight line thermal printing elements and a platen roll for the printing elements has an axis of rotation wherein the print head is pivotally mounted for movement into and out of cooperation with the platen roll, and wherein the structure for mounting the print head has a pivotal axis which is selectively adjustable to bring the line of printing elements into parallel relationship with regard to the platen roll axis.

It is still another object of the invention to provide an improved thermal printing apparatus in which an ink ribbon is advanced through a slip clutch and a carrier web for labels is also advanced through another slip clutch.

It is another object of the invention to provide an improved printing apparatus including a thermal print head, an arrangement for advancing a thermal ribbon including a rewinder, with the rewinder including a driven spindle, a ribbon roll mounting member and a slip clutch for drivingly connecting the spindle and the ribbon roll mounting member.

It is yet another object of the invention to provide an improved printing apparatus for printing on labels releasably adhered to a carrier web and a delaminator for delaminating printed labels, wherein a rewinder is used to tension the carrier web, and wherein the rewinder includes a driven spindle, a carrier web mounting member for mounting the carrier web in roll form, a slip clutch drivingly connecting the spindle and the carrier web mounting member.

It is another object of the invention to provide an improved thermal printing ribbon handling arrangement in a thermal printing apparatus, wherein a spindle is provided and there is a continuous brake on the spindle for applying braking force to a printing ribbon supply roll to maintain tension in the ribbon.

It is yet another object of the invention to provide an improved printer having a housing which includes a sliding cover and tracks comprised of housing components.

It is another object of the invention to provide an improved housing for a printer, wherein a thermal printing mechanism is mounted on a shelf, electronic controls for the mechanism are mounted on a slide below the shelf, and wherein a fan disposed above the shelf is connected to space below the shelf by a duct.

It is still another object of the invention to provide an improved housing for a thermal printing mechanism, wherein the housing includes a shelf having an upper surface for mounting a rotatable label supply roll mounting member, with the shelf having a compartment below the upper surface, and the printing mechanism being disposed partly in the compartment and partly above the upper surface.

It is another object of the invention to provide an improved housing for a printer, wherein the housing includes uniquely arranged printing means, spaced upstanding end plates, a bottom panel disposed below record member mounting means, spaced walls connecting the end plates, a fan mounted on the end plates, and a grill connected to the one end wall and covering the fan.

It is a still further object of the invention to provide an improved ink ribbon guide which improves tracking of the ink ribbon.

It is a further object of the invention to provide an improved printer which is compact, is composed primarily of molded plastics parts, is easy to assemble, is lightweight so as to be portable, and which has relatively few moving parts.

Additional features and objects will be readily apparent to those skilled in the art when reference is made to the following detailed description and the accompanying drawings.

DETAILED DESCRIPTION OF THE PREFERRED EMBODIMENT

Figure 1:
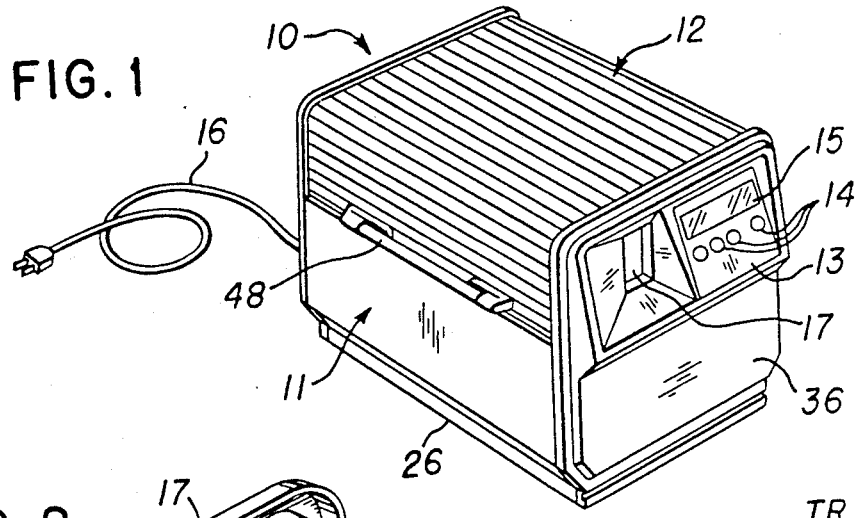
FIG. 1 is a perspective view of the printing apparatus of the invention.

With reference to FIG. 1, there is shown a printing apparatus generally indicated at 10 including a housing generally indicated at 11 having a sliding articulated cover generally indicated at 12. The apparatus 10 has a control panel 13 with control keys 14 and a display 15. The apparatus 10 can be operated by electrical energy supplied via a power cord 16 or via a rechargeable battery (not shown). The apparatus 10 has an opening 17 through which printed tags T or labels L can be dispensed.

Figure 2:
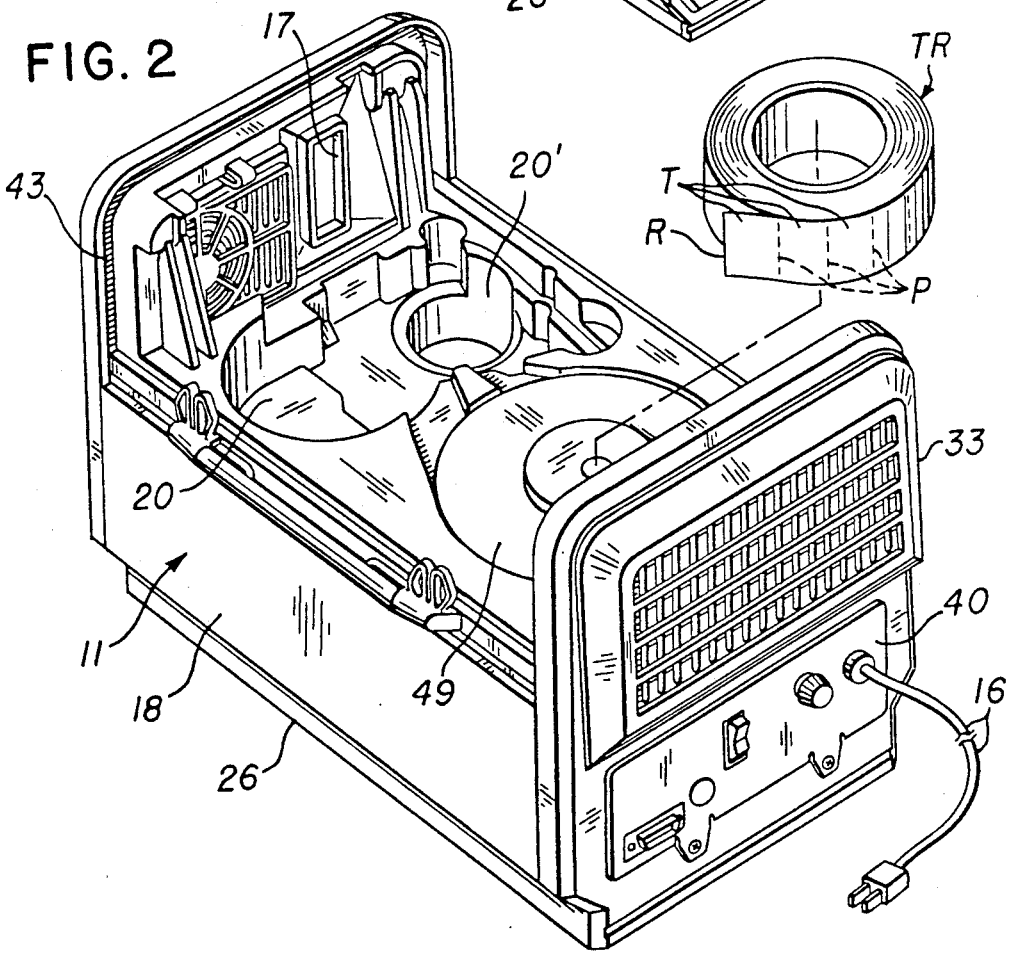
FIG. 2 is an enlarged perspective view of the printing apparatus, without the printing mechanism.
Figure 3:
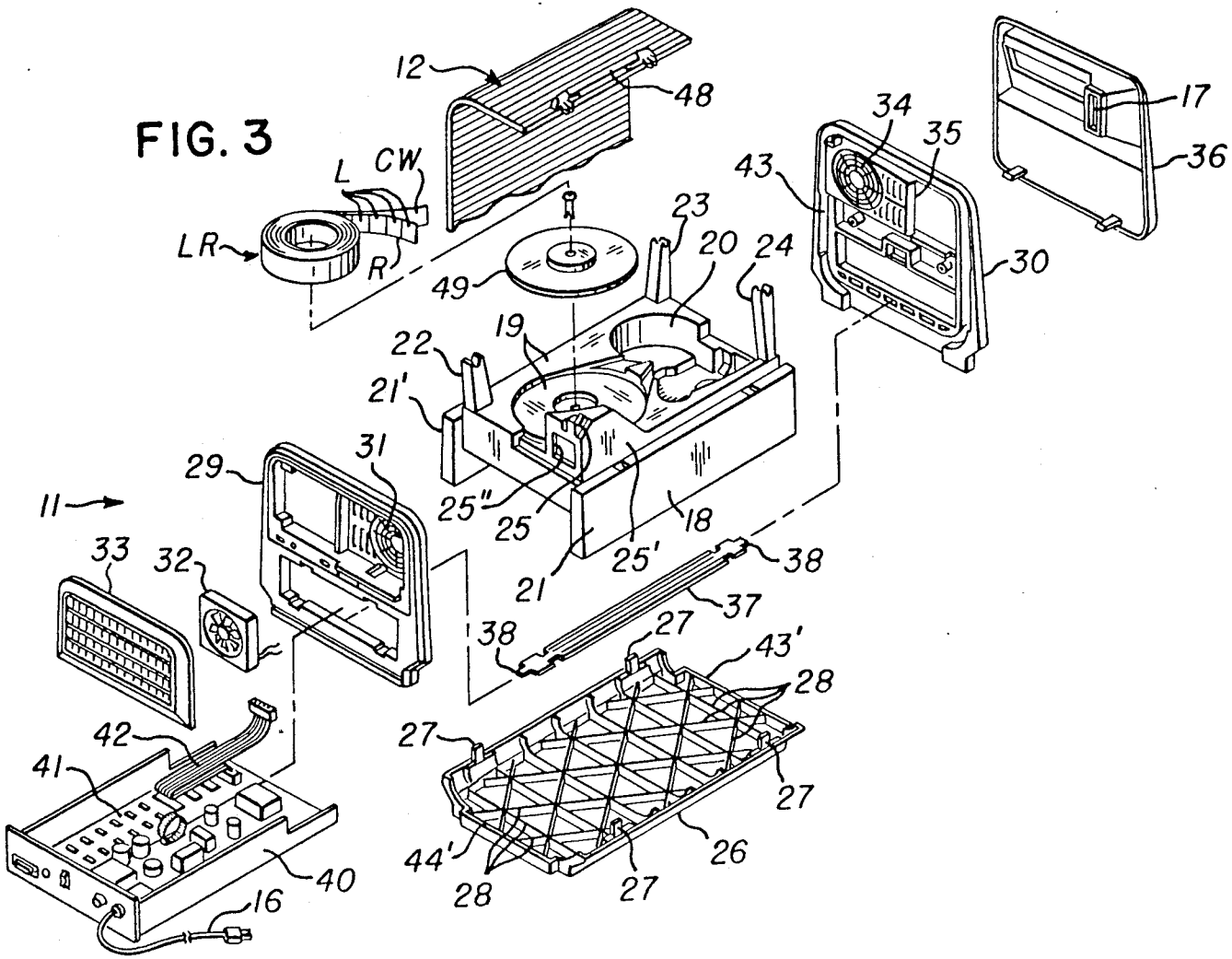
FIG. 3 is an exploded perspective view of the printing apparatus, without the printing mechanism.
Figure 4:
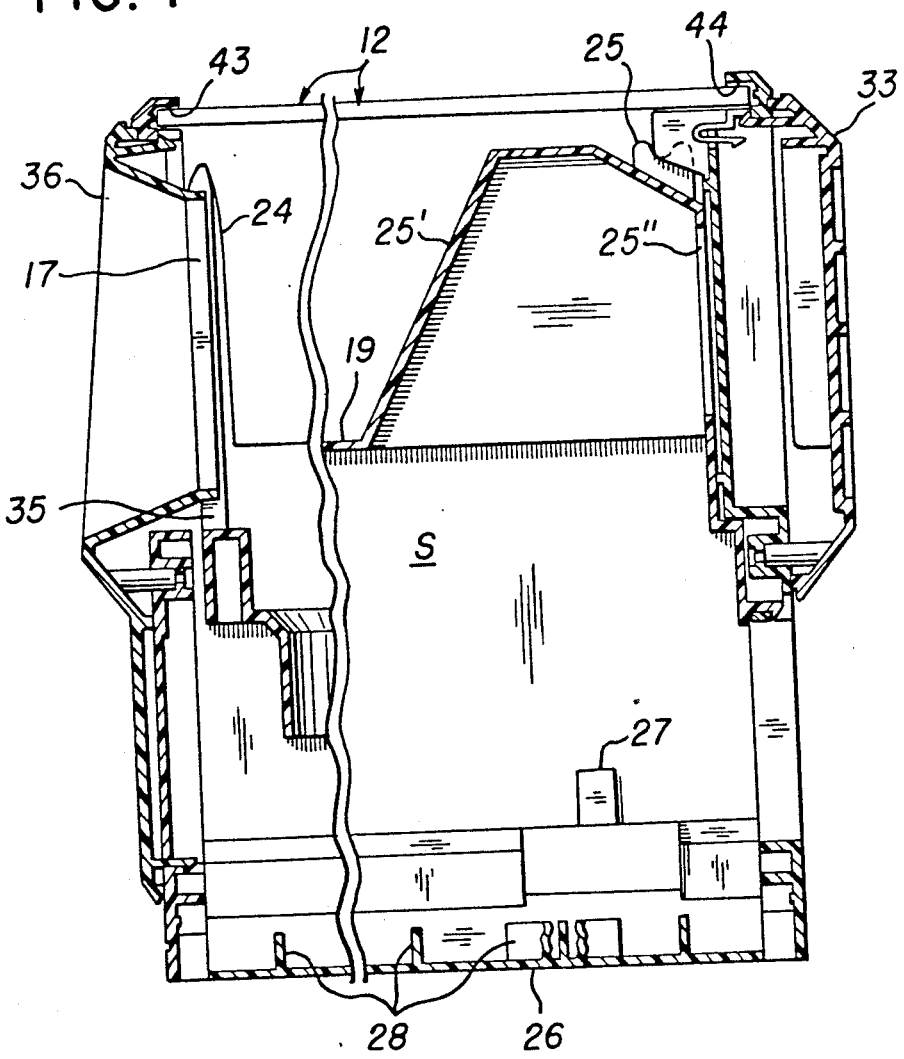
FIG. 4 is a broken-away horizontal sectional view of the housing of the printing apparatus.

With reference to FIGS. 2 and 3, the housing 11 is shown to include a base 18 having an upper surface or shelf 19 with a compartment 20 located below the upper surface 19. The base 18 also has a pair of elongate, parallel, horizontally extending, depending panels 21 and 21' and four upstanding posts 22, 23, 24 and 25. The post 25 is mounted on a duct 25' having a duct opening 25''. The duct 25' communicates with space S below the shelf 19 as best shown in FIG. 4. A bottom panel 26 is snap connected onto the panels 21 and 21' by snap fasteners 27. The panel 26 is thin and is strengthened by interconnecting ribs 28. End panels or end plates 29 and 30 are suitably connected to the base 18. End plates 29 and 30 have upper portions that extend above the shelf 19 and lower portions which extend below the shelf 19. The end plate 29 has a louvered portion 31 aligned with an electric fan 32. A grill 33, which allows the passage of air, is suitably connected to the end plate 29 so that the fan 32 is positioned between the louvered portion 31 and the grill 33. The end plate 30 has a louvered portion 34 and an opening 35. The opening 35 is aligned with the opening 17. A panel 36 in which the opening 17 is formed is suitably connected to the end plate 30.

Figure 5:
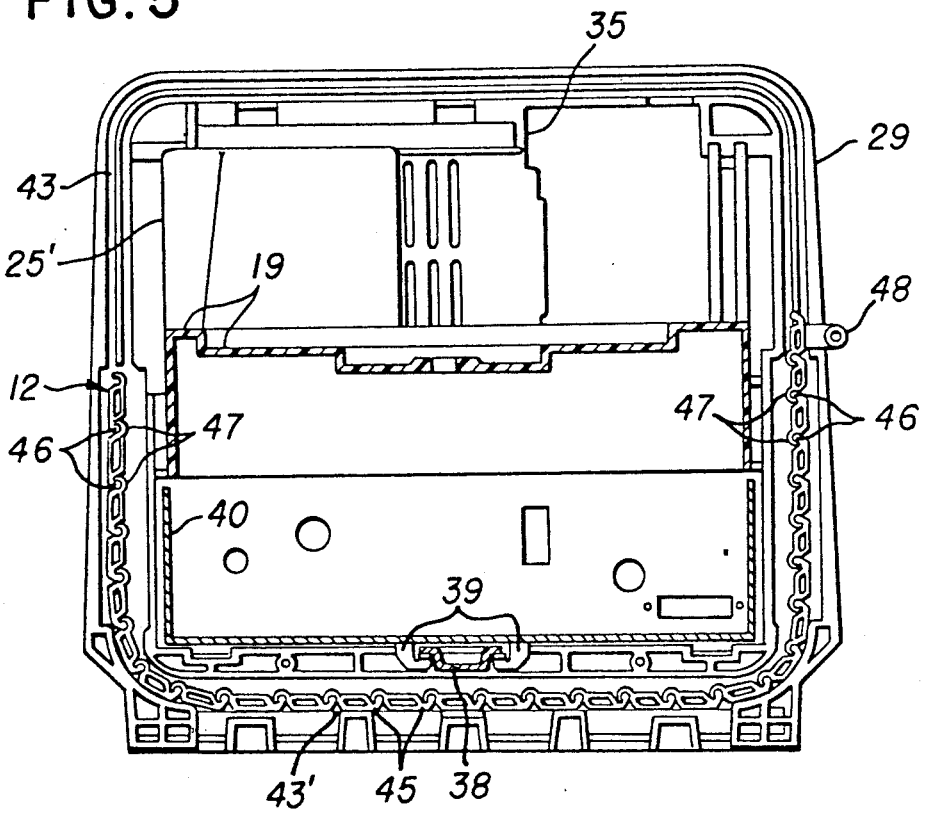
FIG. 5 is a vertical sectional view of the printing apparatus.
Figure 9:
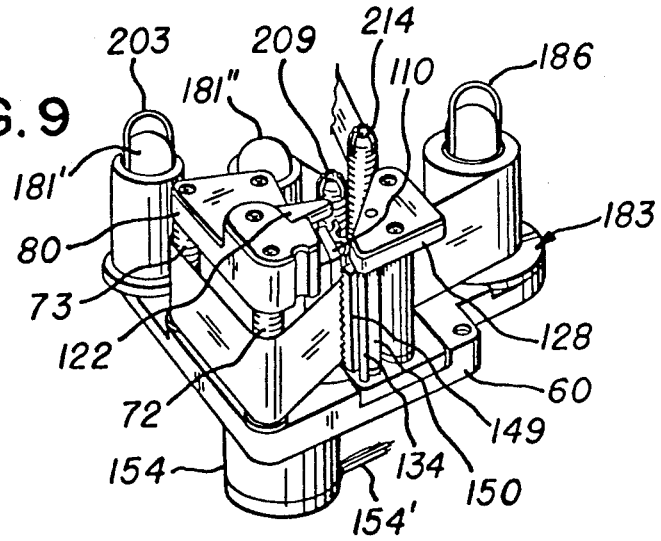
FIG. 9 is a perspective view of the printing mechanism.

A guide 37 having end portions 38 anchored in respective end plates 29 and 30 cooperates with retainers 39 (FIG. 5) secured to the underside of a slide or tray 40. The tray 40 mounts a printed circuit board 41 having electronic controls. The electronic controls are disclosed in a U.S. patent application of Thomas F. Fidler and Patricia Ann Schaeffer filed on even date herewith 296182 and entitled "PRINTER WITH IMPROVED DATA ENTRY", and the disclosure of said U.S. patent application is incorporated herein by reference. A ribbon connector 42 is folded so that the tray 40 can be slid partially out of the housing 18 to provide access to the circuit board 41.

The end plates 29 and 30 have mirror-image tracks 43 and 44 for receiving the sliding cover 12. The cover 12 is comprised of hingedly-connected slats 45. Each slat 45 has a head 46 and a socket 47. The head 46 of one slat 45 is received in the socket of the next adjacent slat 45. The slats 45 are articulated by the heads 46 and sockets 47 so that the cover 12 can track along the tracks 43 and 44 from the closed position shown in FIG. 1 to the open position shown in FIGS. 2 and 5. The tracks 43 and 44 are formed not only in the respective panels 30 and 29, but the bottom panel 26 has track surfaces 43' and 44'. In the open position of the cover 12 shown in FIG. 5, the slats 45 at the bight of the "U" formed by the cover 12 are supported on the surface 43' and by the surface 44' (not shown in FIG. 5 but shown in FIG. 3). The cover 12 is shown to have a handle 48. In its closed position, the cover 12 serves to protect the apparatus 10 from damage and from dust. In its open position, a rotatably mounted spool 49 and a roll LR or TR of record members R which the spool 49 mounts is readily accessible for loading and unloading, and a printing mechanism 50 is also readily accessible for ink ribbon replacement, for easy threading with record members R, and for servicing.

Figure 7:
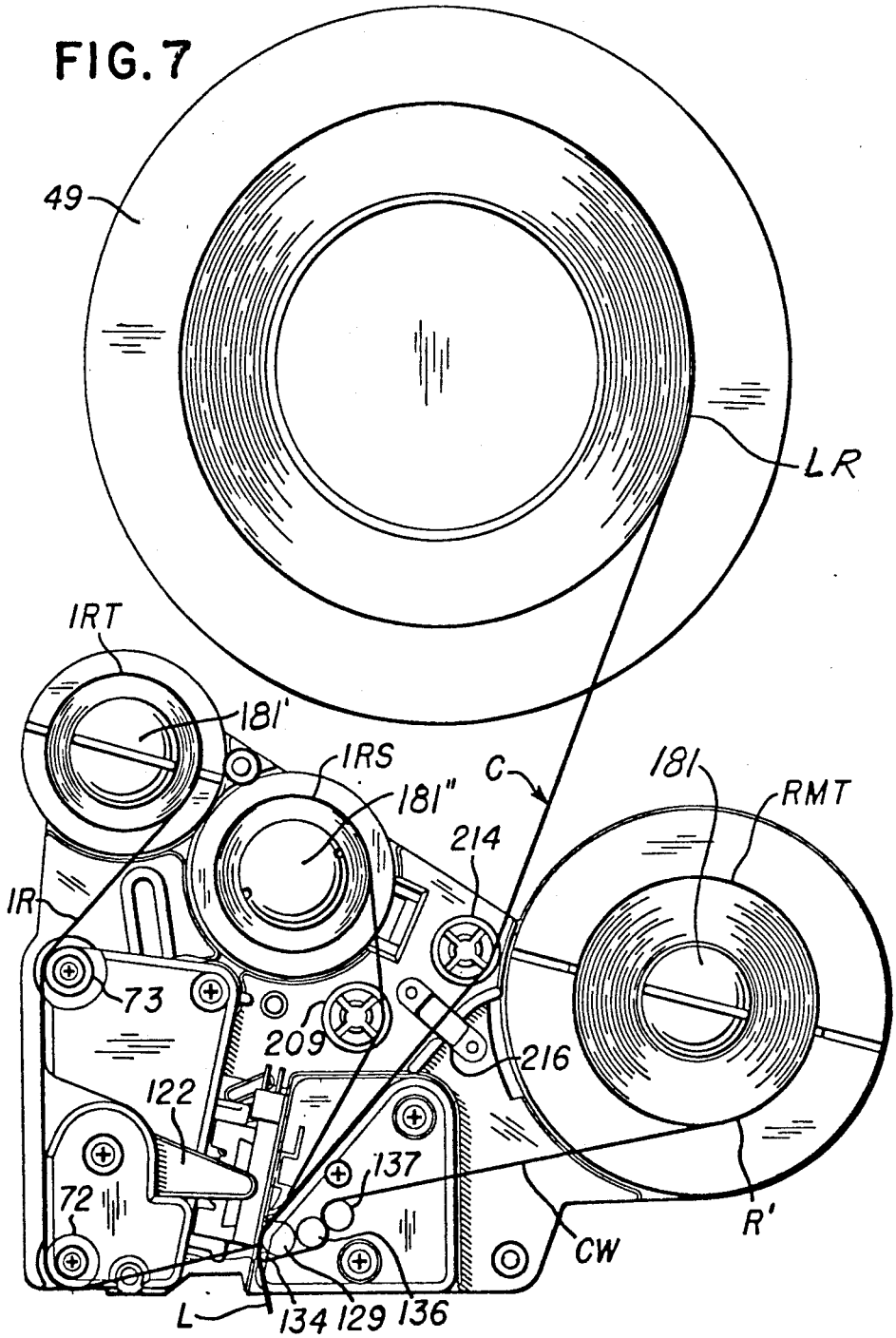
FIG. 7 is a top plan view of the printing mechanism and the supply spool.

The apparatus 10 can print on either tag T or labels L. FIG. 2 shows a tag roll TR of record members R. The record members R are in the form of tags T preferably connected at lines of perforation P. FIGS. 3 and 7 show a label roll LR of a composite web C comprised of pressure sensitive labels L releasably adhered to a carrier web CW.

Figure 11:
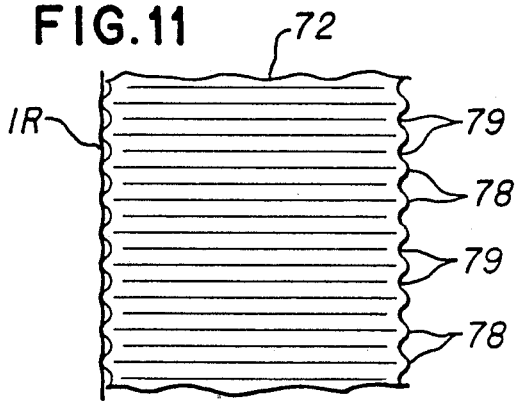
FIG. 11 is a fragmentary view of one of the guides shown guiding the ink ribbon.

With reference to FIGS. 6A through 6D, where is shown a printing mechanism frame 60. Print head mounting structure generally indicated at 61 includes four posts 62, 63, 64 and 65 snugly received and held in respective holes 66, 67, 68 and 69 in the frame 60. The posts 62 and 64 are snap-fitted into respective holes 66 and 68 by means of resilient end portions 70 and 71. Rotatable guides 72 and 73 are snap-fitted onto the respective posts 62 and 64. Resilient end portions 74 and 75 are snap-fitted into respective grooves 76 and 77 on respective shafts 62 and 64. The guides 72 and 73, which have closely spaced continuous annular ridges 78 with intervening grooves 79 (FIG. 11), are used to guide a thermally sensitive ink ribbon IR. The ridges 78 and grooves 79 to which the tensioned ink ribbon IR generally conforms is best shown in FIG. 11. The ridges 78 and grooves 79 facilitate tracking of the ink ribbon IR. The print head mounting structure includes a plate 80 having shouldered holes 81 for receiving end portions of the posts 62 through 65. Screws 82 passing through washers are received in threaded holes 84 in the posts 62 through 65 to connect the plate 80 securely to the posts 62 through 65.

Figure 10:
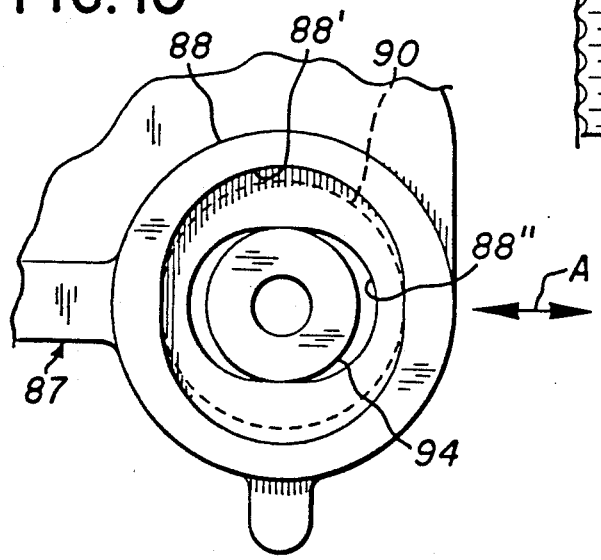
FIG. 10 is a top plan view showing portions of the adjustment mechanism for the print head.

The post 65 receives an elastomeric washer 85 which bears against a flange 65' on the post 65. The washer 85 has a convex or crowned upper surface 86. A mounting member generally indicated at 87 has a tubular portion 88 with a concave annular end surface 89. The surfaces 86 and 89 contact and mate with each other and enable the mounting member 87 to be skewed on the post 65 upon rotation of a cam in the form of an eccentric 90. The eccentric 90 is shown is solid lines in FIG. 6 and in broken lines, for clarity, in FIG. 10. The eccentric 90 is received in a follower hole 88' in tubular portion 88 and has a knurled manually engageable flange 91 by which the eccentric 90 can be rotated when the alignment of print head 111 is to be manually adjusted. A flat elastomeric washer 92 is received on the post 65 between surface 93 and the plate 80. The washer 92 helps hold the eccentric 90 in its adjusted position. The post 65 has an annular surface 93' which snugly receives the crowned washer 85. The post 65 also has an annular bearing portion 94 which has a diameter substantially smaller than the diameter of the portion 93'. The eccentric 90 has a round hole 90' which receives the bearing portion 94. The portions 93 and 94 are joined by a tapered portion 95. Directly below the follower hole 88' is an elongated slot 88'' which confines movement of the mounting member 87 in a flat plane in the directions of double-headed arrow A in FIG. 10 upon rotation of the eccentric 90. To adjust the eccentric 90, the associated screw 82 is loosened and the flange 91 is manually gripped and rotated slightly. This causes the tubular portion 88 of the mounting member 87 to shift in either direction of the double-headed arrow A depending upon the direction of rotation of the eccentric 90. Thus, a straight line of printing elements 112 on print head 111 can be brought into parallel alignment with rotational axis of platen roll 129 of platen 125. When adjusted, the associated screw 82 is tightened to hold the eccentric 90 in its adjusted position It is readily apparent that adjustment of the eccentric 90 results in adjustment of the axis of the tubular portion 88.

The mounting member 87 has a bore 96 in which a cup-shaped follower 97 is keyed. The follower 97 has a flange 98 that bears against surface 99. A spring 100 bears against the bottom of the cup 97 and against a plate 101. The plate 101 has heat-dissipating fins 102. The plate 101 is pivotally mounted on axially aligned pins 102' received in axially aligned holes 103 in the mounting member 87 and in axially aligned holes 104 in the plate 101. The pins 102' pivotally mount the plate 101 on an axis which is perpendicular to the axis of the tubular portion 88 of the mounting member 87. The plate 101 has a dovetail slot 105 formed by inclined surfaces 106. A print head mounting member or plate 107 has inclined ends formed by inclined ridges 108 which match the inclined surfaces 106. To assemble the plate 107 onto the plate 101, the plate 107 is slid into the dovetail slot 105. Thereafter, a screw 109 is threaded into a plate 110 on which the print head 111 is mounted. The print head 111 includes dot-type thermal heating elements 112 preferably arranged in a straight line as shown. The screw 109 is inserted through a clearance hole 113 on the plate 101. A resilient ring 114 is snapped into a groove 115 on the screw 109 to retain the plate 107 in place. The plate 107 has locator pins 116 received in holes 117 in the plate 110. The print head 111 is connected to the electronic controls via a flexible ribbon connector 118 and a stationary connector 119. The ribbon connector 42 is connected to the stationary connector 119.

Figure 8:
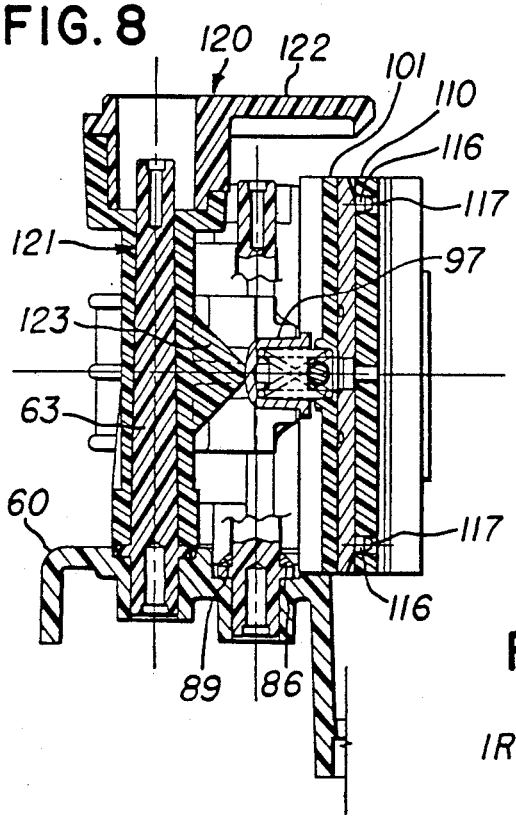
FIG. 8 is a vertical sectional view of the print head position control device.

An actuator generally indicated at 120 includes a cam generally indicated at 121 and a lever or handle 122 keyed to the cam 121. The cam 121 includes a print head control cam 123 and a switch cam 124 for operating a switch 124'. The control cam 123 acts on the follower 97 as best shown in FIG. 8. Manual movement of the handle 122 rotates the cams 123 and 124. In FIG. 7, the handle 122 and the cams 123 and 124 are in the normal or operating position, and counterclockwise movement of the handle 122 causes the handle 122 and cams 123 and 124 to be in the non-operating or loading position. To move the mounting member 87 to the non-operating or loading position the high point of the cam 123 cooperates with cam follower surface 87' on the mounting member 87. In the loading position, the print head 111 is spaced from the platen generally indicated at 125. The spring 100 is partially loaded even when the handle 122 is in the loading position. The partially-loaded spring 100 is held captive between the cup 97 and the plate 101. However, movement of the handle 122 to the operating position (FIG. 7) causes the spring 100 to be further compressed to increase the pressure of the print head 111 against the platen 125. The spring 100 is forgiving enough to enable either tags T or labels L to be printed without adjustment. Tags T are typically thicker than composite label webs C. In the operating position of the handle 122, the switch cam 124 operates the switch 124' to signal the electronic controls that the print head 111 is in its printing position ready to print. In the non-operating position, the switch cam 124 operates the switch 124' to signal that the print head 111 is in its non-operating position and hence disables the printing apparatus 10.

Figure 6A:
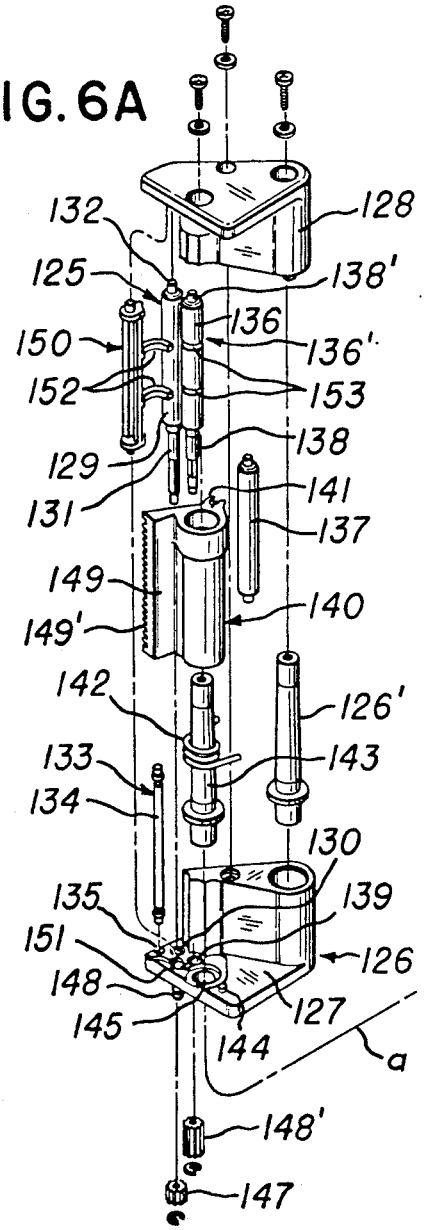
FIGS. 6A through 6D are exploded perspective views of four portions of the printing mechanism.

With reference to FIG. 6A, mounting structure generally indicated at 126 indicates a mounting block 127 and a mounting block 128. The platen 125 is shown to be a rotatable platen roll 129 rotatably mounted on a fixed axis in a hole 130 in the mounting block 127 and in a hole (not shown) in the mounting block 128 by respective shaft portions 131 and 132. A delaminator generally indicated at 133, shown to comprise a peel roller 134, is rotatably mounted in a hole 135 in the mounting block 127 and in a hole (not shown) in the mounting block 128.

A tensioning mechanism generally indicated at 136' includes a tensioning roll 136 and a back-up roll 137. The tensioning roll 136 is spaced from the platen roll 129 and is rotatably mounted at its shaft portion 138 in hole 139 and at its shaft portion 138' in a hole (not shown) in the mounting block 128. The roll 137 is rotatably mounted on a support generally indicated at 140 at spaced projections 141 (only one of which is shown). The support 140 is urged counterclockwise (FIG. 6) by a spiral spring 142. The spring 142 is received about a post 143 and bears against a projection 144 on the mounting block 127 and against the support 140. The post 143 is shown to be received in a hole 145 in the mounting block 127. The spring 142 thus urges the back-up roll 137 into cooperation with the tensioning roll 136. A driven gear 146 on the shaft portion 131 meshes with an idler gear 147 mounted on a stud 148. The idler gear 147 meshes with a gear 148' on the shaft portion 138 of the tensioning roll 136. The gear ratio on the gear train provided by the gears 146, 147 and 148' causes the tensioning roll 136 to be driven at a slightly greater peripheral speed than the peripheral speed of the platen roll 129. As the carrier web CW passes between the print head 111 and the platen roll 129, the carrier web CW is advanced at a selected speed, but because the driven tensioning roll 136 is driven at a higher speed than the platen roll 129, the carrier web CW is always under tension from the place where the print head 111 and the platen roll 129 cooperate, around the peel roller 134, and to the nip of the rolls 136 and 137. It is to be understood that there is slippage between the tensioning roll 136 and the carrier web CW. When threading the carrier web CW between the rolls 136 and 137, the user presses on the lever or handle 149 to overcome the force of the spring 142 and to pivot the support 140 clockwise (FIG. 6). This causes the roll 137 to move away from the roll 136 so that the free end of the carrier web CW can be readily threaded between the rolls 136 and 137. A guide generally indicated at 150 is received at its ends in a hole 151 in the mounting block 127 and in a hole (not shown) in the mounting block 128. The guide 150 has a pair of arcuate guide members 152 received in grooves 153 in the roll 136. The guide members 152 guide the carrier web CW from the peel roller 134 to the nip between rolls 136 and 137 which is especially useful in threading the carrier web CW. Moreover, the guide members 152 prevent the carrier web CW from going between the platen roll 129 and the roll 136.

The support 140 is shown to have a serrated cutting edge 149' which can be used to tear off either the carrier web CW or the tags T from the tag roll TR.

An electric motor 154, preferably of the stepping motor type, is secured by screws 155 (only one of which is shown) to the underside of the frame 60. The motor 154 is disposed in open-ended tubular portion 20' in the compartment 20. The tubular portion 20' opens into space below the compartment 20. A toothed pulley 156 is secured to motor shaft 157. An endless toothed belt 158 meshes with the upper half of the pulley wheel 156 at 159 and meshes with a toothed pulley wheel 160 at 161. A bracket 162 mounted to the underside of the frame 60 rotatably mounts the composite gear 146 and toothed wheel 160. A belt 163 meshes with a toothed pulley wheel 165 (FIG. 6D) at 166 and with a toothed pulley wheel 167 at 168. The belt 163 also meshes with the lower half of toothed wheel 156 at 164.

A belt tensioning device 169 includes a roll 170 on which wheels 171 having flanges 172 are received. A washer-shaped separator 173 is also received on the roll 170 between the wheels 171. The lower flange 172 and the separator 173 contact the outside of the belt 163. The upper flange 172 and the separator 173 contact the outside of belt 158. The belts 158 and 163 have sides 158' and 163' that overlap to form a "V". The wheels 171 contact the sides 158' and 163' and simultaneously tension both belts 158 and 163. The roll 170 has stub ends 175 held in spaced recesses 176 in a holder 177. A compression spring 179 acts on the holder 177 to urge the wheels 171 against the belts 158 and 163. Opposed pins (not shown) secured to the underside of the frame 60 pass from the outside into elongated slots 178 to mount the holder 177. End 179' of the spring 179 bears against a stationary spherical abutment (not shown).

The carrier web CW is rewound by a carrier web rewinder or rewind mechanism generally indicated at 180. The mechanism 180 applies tension to the carrier web CW from between the nip of the rolls 136 and 137 to the place where the carrier web CW is wound onto the roll R'. The free end portion of the carrier web CW is wrapped around hub 181 with the lower edge of the carrier web against a disc or plate 182. The hub 181 and the plate 182 constitute a spool 183. The hub 181 has diametrically opposed longitudinal grooves 184 and the plate 182 has diametrically opposed radial grooves 185. With the free end portion of the carrier web CW wrapped about the hub 181, a hat-shaped bail 186 having leg portions 187 and stripper portions 188 is slid onto the hub 181 with the legs aligned with the grooves 184 until the stripper portions 188 bottom in the grooves 185. Thus, the end portion of the carrier web CW is captured between the hub 181 and leg portions 187. A spindle 189, with the toothed pulley wheel 165 integral therewith, receives a mounting member 190 below the plate 182, and receives a clutch 191 comprised of a disc or clutch plate 192, a clutch member 193, a spring 194 and a retainer 195 above the plate 182. The mounting member 190 is snap-fitted into a hole **190*a* in the frame 60. The mounting member 190 is keyed against rotation in the hole 190*a* but can be removed therefrom by pulling the assembly 180 upwardly. This causes the mounting member 190 to be unsnapped from within the hole 190*a*. The hub 181 has a pair of depending snap connectors 196 which snap into the disc 182. The spool 183 is driven through the clutch 191. The spindle 189 has resilient snap members 197 which snap over the retainer 195. As shown the spindle 189 is D-shaped and the clutch member 193 and the retainer 195 have D-shaped holes. Thus, the spindle 189, the clutch member 193 and the retainer 195 rotate as a unit. The spring 194 urges the clutch member 193 against the disc 192 which is preferably made of elastomeric material such as polyurethane. The disc 192 bears against clutch surface 198. Accordingly, motion from the spindle 189 is transmitted to the disc 182 through the clutch 191. The hub 181 is keyed to and hence rotates as a unit with the disc 182. As the hub 181 rotates, tension is applied to the carrier web CW. The spindle 189 is always driven faster than required to keep the carrier web CW under tension even when the platen roll 129 is rotating. The clutch 191 slips whenever the motor shaft 157 is rotating and applies the needed rewinding force to the carrier web CW. A washer 189*a* press-fitted into the end of the spindle 189 retains the belt 163 on the toothed wheel 165**.

Ink ribbon rewind mechanism or rewinder 180' identical in many respects to the carrier web rewind mechanism 180 so the same reference characters are used with the addition of a prime, however, components that are not identical are indicated with different reference characters. The mechanism 180' includes a disc or plate 200 similar to the plate 182, however, the plate 200 is of lesser diameter, does not have grooves 185, but has external ridges and grooves 201 in wall 202. The wall 202 is split into two parts, whereas wall 182w on the plate 182 is split into four parts. Also, bail 203 has legs 204 that are shorter than the legs 187. The mechanism 180' maintains tension in the ink ribbon IR from the place where the print head 111 contacts the platen roll 129 to the place where the ink ribbon IR is wound into the take-up or spent ribbon roll IRT. The ink ribbon IR is initially on a supply roll IRS mounted on an ink ribbon supply mechanism 180''.

The mechanism 180'' is the same as the mechanism 180, except that the brake plate or disc 192'' is positioned between the flat lower surface of the plate 200'' and the spacer 190''. The brake disc 192'' bears against upper surface 205 of the non-rotatable mounting member 190''. The upper surface 205 has slots 206. Because the brake disc 192'' is elastomeric, the brake disc 192'' deforms into the slots 206. Therefore, braking action takes place between the upper surface of the clutch disc 192'' and the underside of plate 200''. The inside of the ink ribbon supply roll IRS makes snug contact with ridges and grooves 201''. As the ink ribbon IR is advanced by the coaction of the platen roll 129 on the record members R and by the mechanism 180', the mechanism 180'' applies slight drag to the ink ribbon IR to maintain tension from the place where the ink ribbon IR is paid out of the roll IRS and the platen roll 129.

Figure 6B:
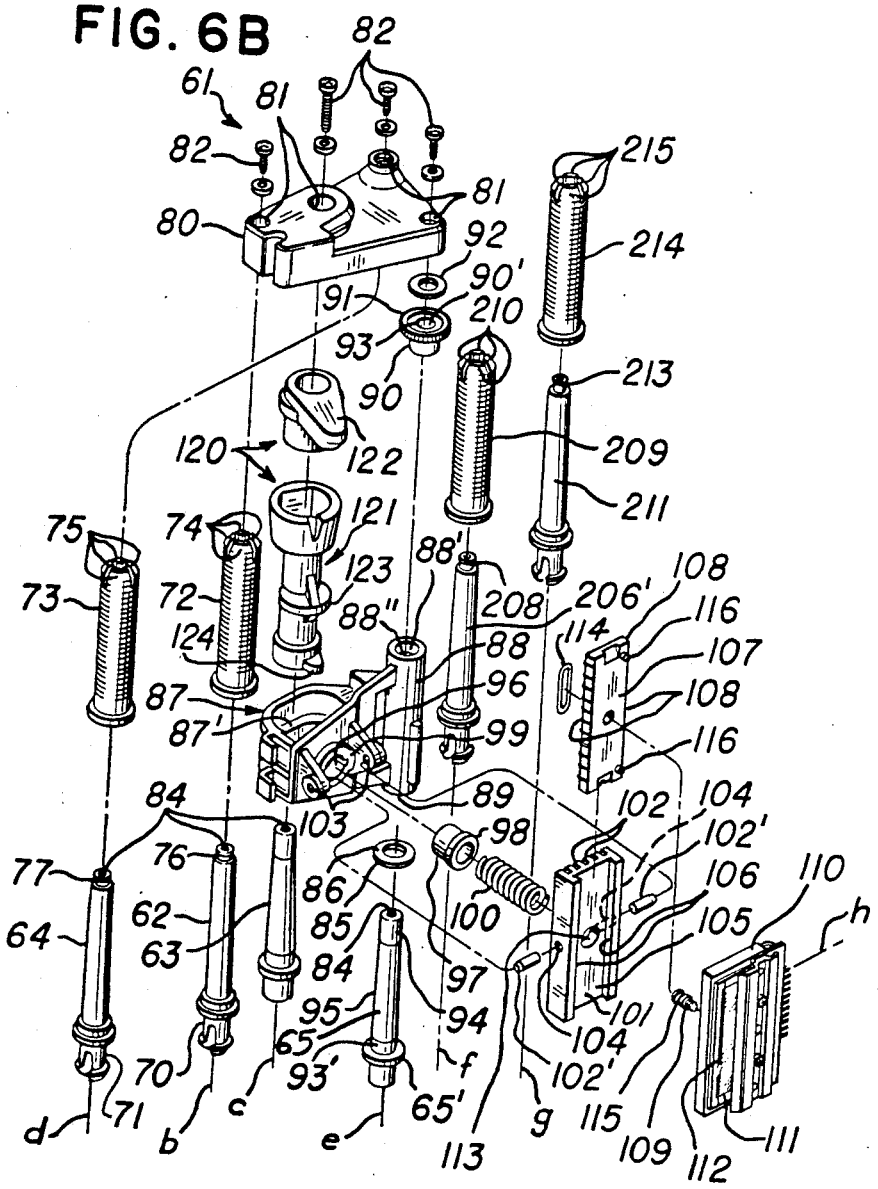
Figure 6C:
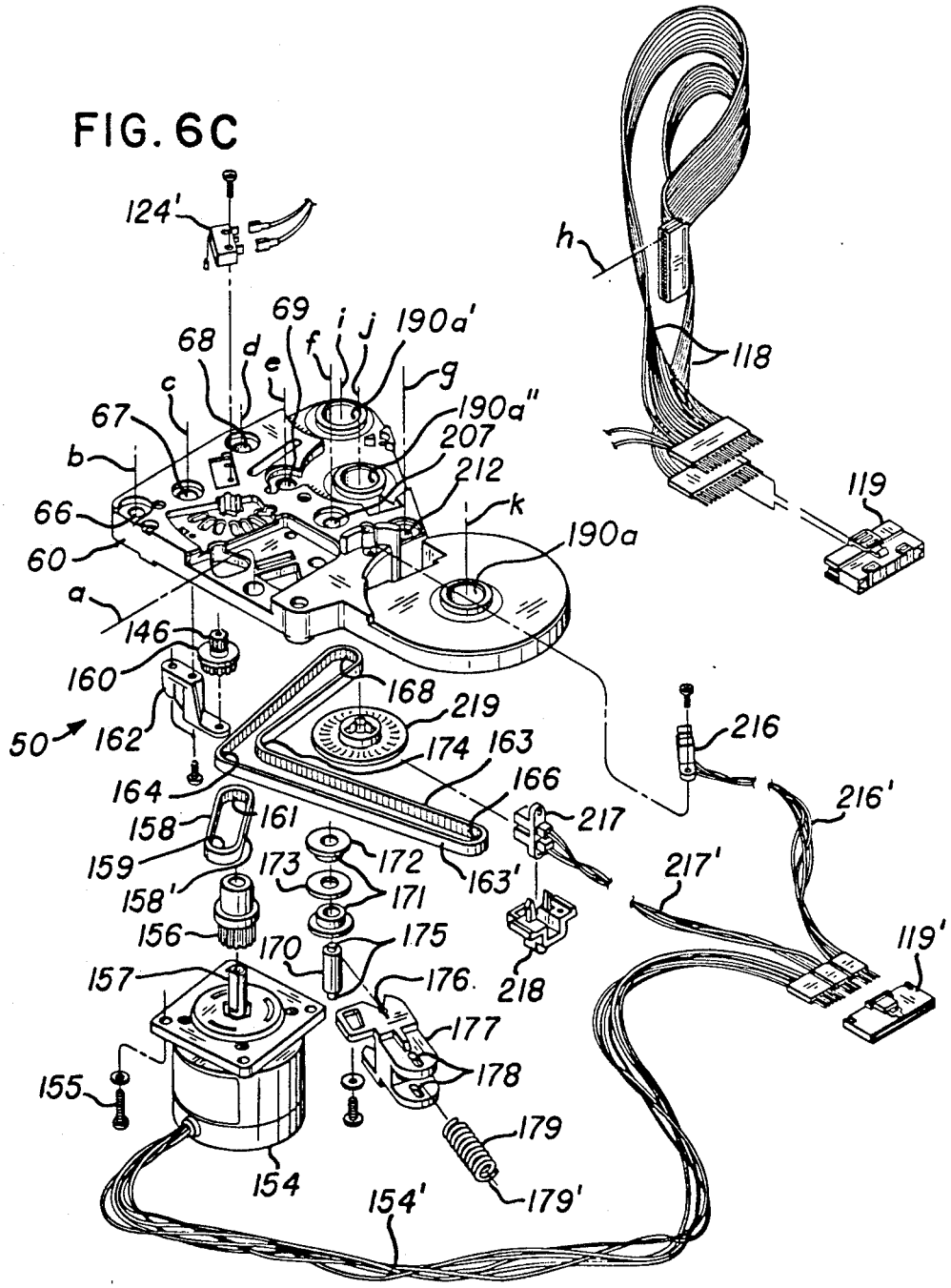
Figure 6D:
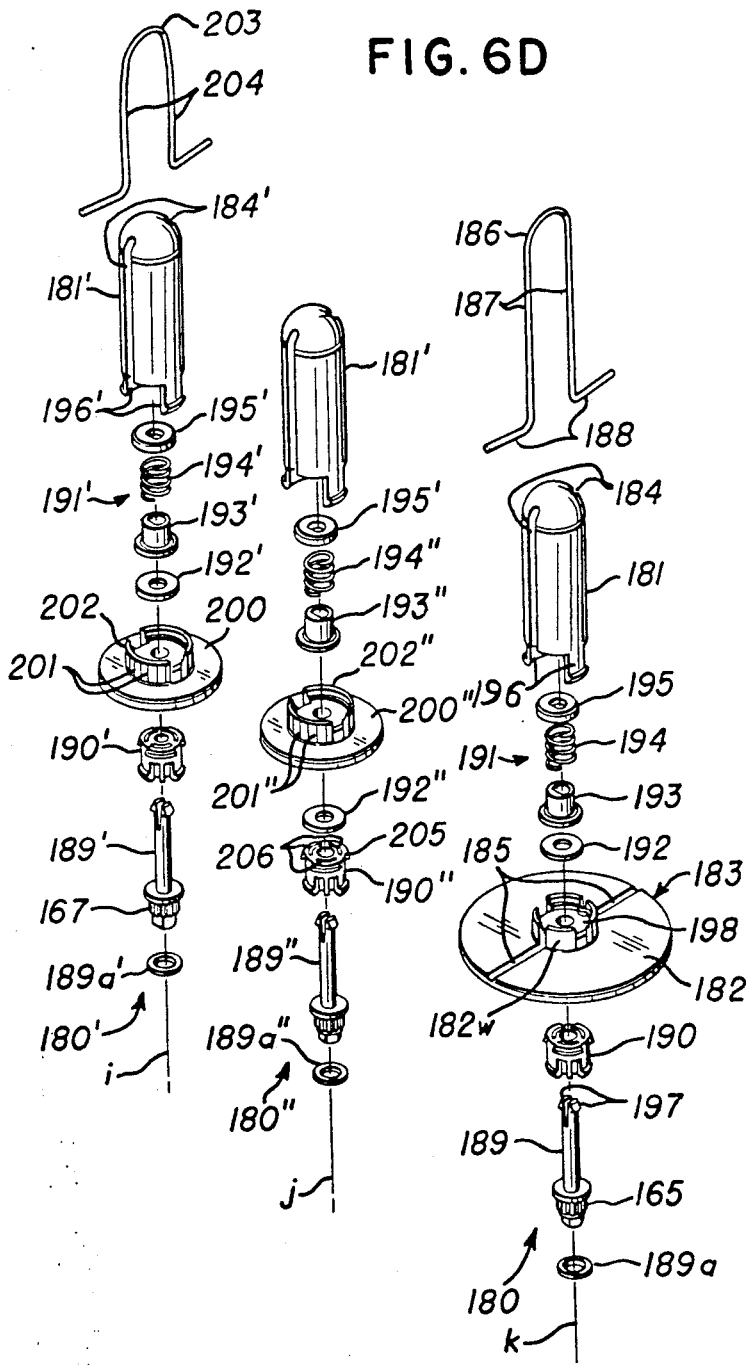

Referring to FIGS. 6B and 6C, a post 206 is snapped into a hole 207 in the frame 60. The post 206 has a groove 208. A rotatable guide 209 having resilient fingers 210 is received over the post 206' and the fingers 210 are snapped into the groove 208. The ink ribbon IR is guided by the guides 72, 73 and 209 as shown in FIG. 7.

A post 211 is snapped into a hole 212 in the frame 60. The post 211 has a groove 213. A rotatable guide 214 having resilient fingers 215 is received over the post 211 and the fingers 215 are snapped into the groove 213. The composite web C is guided by the guide 214 as shown in FIG. 7.

The apparatus 10 has a switch 216 (FIG. 6C) for sensing the absence of a supply web of either tags T or labels L. Absence will disable to printing apparatus 10.

A switch 217, secured to the underside of the frame 60 by a bracket 218, cooperates with an apertured disc 219 on spindle 189" to detect rotation of the spindle 189". If the spindle 189" fails to make the desired number of rotations within a predetermined time, a jam or out-of-stock condition is presumed and the apparatus 10 is disabled. Leads 216', 217' and 154' connect the switch 216, the switch 217 and the motor 154 to a stationary connector 119'. The ribbon connector 42 is connected to the connectors 119 and 119'.

The apparatus 10 uses a number of identical parts for the same of economy of manufacture, namely guides 72, 73, 209 and 214 are identical; posts 62, 64, 206 and 211 are identical; posts 63, 95, 126' and 143 are identical; and most of the parts of the mechanism 180, 180' and 180" are identical. The printer 10 is constructed almost entirely of plastics material except for a motor of the fan 32, the motor 154, the print head 111, springs 100, 142, 178, 194, 194' and 194", the guide 37, the slide or tray 40, elastomeric belts 158 and 163, posts 63, 65, 126' and 143, the shafts or shaft portions on which elastomeric rolls 129, 136 and 137 are mounted, and miscellaneous screws, washers, clips, pins, electrical wires and switches.

To load the apparatus 10, the handle 122 is positioned in its non-operating position and for example a composite label web C is threaded into position, namely a label roll LR is positioned on supply spool 49 and the composite web C is guided past the guide 214, through the switch 216, and to between the print head 111 and the platen roll 129 As the carrier web CW makes a sharp angle around the peel roller 134, labels L are stripped from the carrier web CW. The handle 149 is moved so that the tensioning roll 137 is moved apart from the tensioning roll 136. The free end of the carrier web CW is passed between the spaced rolls 136 and 137 and, with the bail 186 removed, the marginal end portion of the carrier web CW is wrapped once around the hub 181. The bail 186 is now inserted into the grooves 184 and 185. To load the ink ribbon IR, a supply roll IRS of thermally sensitive ink ribbon IR is positioned on the hub 181" and in snug contact with ridges 201" on wall 202". The ink ribbon IR is now passed into contact with the guide 209 and to between the print head 111 and the platen roll 129, about guides 72 and 73 and to an ink ribbon take-up roll IRT. With a wrap of the free end portion of the ink ribbon IR on the hub 181' the bail 203 is positioned in grooves 184'. The handle 122 is now ready to be moved to the operating position shown in FIG. 7.

Other embodiments and modifications of this invention will suggest themselves to those skilled in the art, and all such of these as come within the spirit of this invention are included within its scope as best defined in the appended claims.

We claim:

1. Printing apparatus, comprising: a platen roll having an axis of rotation, a thermal print head having thermal printing elements disposed in a straight line and cooperable with the platen roll, and means for mounting the print head, the mounting means including a stationary post generally parallel to the platen roll axis, a mounting member connected to the print head, the mounting member being pivotally supported on the post, and means for adjusting the mounting member relative to the post to bring the line of printing elements into parallel relationship with respect to the platen roll axis.

2. Printing apparatus, comprising: a platen roll having an axis of rotation, a thermal print head having thermal printing elements disposed in a straight line and cooperable with the platen roll, and means for mounting the print head, the mounting means including a stationary post generally parallel to the platen roll axis, a mounting member connected to the print head, the mounting member being pivotally supported on the post, means for adjusting the mounting member relative to the post to bring the line of printing elements into parallel relationship with respect to the platen roll axis, and wherein the adjusting means includes means for confining adjusting movement of the mounting member to a flat plane.

3. Printing apparatus, comprising: a frame, a platen roll having an axis of rotation, a thermal print head having thermal printing elements disposed in a straight line and cooperable with the platen roll, and means for mounting the print head, the print head mounting means including a plate and three stationary posts connected to the plate and to the frame, a mounting member connected to the print head, wherein one of the posts is generally parallel to the print head axis and pivotally supports the mounting member thereon, and means for adjusting the mounting member relative to said one post to bring the line of printing elements into parallel relationship with respect to the platen roll axis.

4. Printing apparatus, comprising: a platen, a thermal print head cooperable with the platen, means for mounting the print head for pivotal movement into and out of printing cooperation with the platen, the mounting means including a post, a mounting member mounted for pivotal movement about the post, and a plate on the mounting member for supporting the print head, the mounting member having means for providing a cam follower surface, a cam follower mounted on the mounting member, a partially loaded compression spring acting against the follower and the plate, a manually operable cam for alternately acting on the cam follower to further load the spring and urge the print head into pressure contact with the platen or acting on the cam follower surface to move the print head out of contact with the platen, and wherein the cam is captive between the cam follower surface and the cam follower.

5. Printing apparatus, comprising: a platen, a thermal print head cooperable with the platen, means for mounting the print head for movement into and out of printing cooperation with the platen, the mounting means including a post, a mounting member mounted for pivotal movement about the post, a plate for supporting the print head, and means for pivotally mounting the plate on the mounting member, the mounting member having means for providing a cam follower surface, a cam follower mounted on the mounting member, a partially loaded compression spring acting against the follower and the plate, a manually operable cam for alternately acting on the cam follower to further load the spring and urge the print head into pressure contact with the platen or acting on the cam follower surface to move the print head out of contact with the platen, and wherein the cam is captive between the cam follower surface and the cam follower.

6. Printing apparatus, comprising: a platen, a thermal print head cooperable with the platen, means for mounting the print head for pivotal movement into and out of printing cooperation with the platen, the mounting means including a post, a mounting member mounted for pivotal movement about the post, and a plate on the mounting member for supporting the print head, the mounting member having means for providing a cam follower surface, a cup-shaped cam follower mounted on the mounting member, a partially loaded compression spring acting against the plate and active against and received in the follower, a manually operable cam for alternately acting on the cam follower to further load the spring and urge the print head into pressure contact with the platen or acting on the cam follower surface to move the print head out of contact with the platen, and wherein the cam is captive between the cam follower surface and the cam follower.

7. Printing apparatus, comprising: a platen, a thermal print head cooperable with the platen, means for mounting the print head for pivotal movement about a print head axis into and out of printing cooperation with the platen, the mounting means including a stationary post, a mounting member mounted for pivotal movement about the post, wherein the mounting member includes a tubular portion having an elongate slot, wherein the post is in guiding relation in the slot, means for adjusting the position of the print head axis, wherein the adjusting means includes an eccentric, wherein the tubular portion has a hole with a cam profile for receiving the eccentric, a plate on the mounting member for supporting the print head, the mounting member having means for providing cam follower surface, a cam follower mounted on the mounting member, a partially loaded compression spring acting against the follower and the plate, a manually operable cam for alternately acting on the cam follower to further load the spring and urge the print head into pressure contact with the platen or acting on the cam follower surface to move the print head out of contact with the platen, and wherein the cam is captive between the cam follower surface and the cam follower.

8. Printing apparatus, comprising: a platen roll having an axis of rotation, a thermal print head having thermal printing elements disposed in a straight line and cooperable with the platen roll, means for mounting the print head for pivotal movement into and out of printing cooperation with the platen, the mounting means including a stationary post generally parallel to the platen roll axis, a mounting member mounted for pivotal movement about the post, a plate on the mounting member for supporting the print head, and means for adjusting the mounting member relative to the post to bring the line of printing elements into parallel relationship with respect to the platen roll axis, the mounting member having means for providing a cam follower surface, a cam follower mounted on the mounting member, a partially loaded compression spring acting against the follower and the plate, a manually operable cam for alternately acting on the cam follower to further load the spring and urge the print head into pressure contact with the platen or acting on the cam follower surface to move the print head out of contact with the platen, and wherein the cam is captive between the cam follower surface and the cam follower.

9. Printing apparatus, comprising: a frame, a platen, a thermal print head cooperable with the platen, means for mounting the print head for pivotal movement into and out of printing cooperation with the platen, the mounting means including a plate and three stationary posts connected to the plate and to the frame, a mounting member mounted for pivotal movement about one of the posts, and a plate on the mounting member for supporting the print head, the mounting member having means for providing cam follower surface, a cam follower mounted on the mounting member, a partially loaded compression spring acting against the follower and the plate, a manually operable cam for alternately acting on the cam follower to further load the spring and urge the print head into pressure contact with the platen or acting on the cam follower surface to move the print head out of contact with the platen, and wherein the cam is captive between the cam follower surface and the cam follower.

10. Printing apparatus comprising: a thermal print head having thermal printing elements disposed in a straight line, a platen roll having an axis of rotation, means for mounting the print head for pivotal movement about a print head axis into and out of printing cooperation with the platen, means for adjusting the position of the print head axis, means for confining movement of the print head axis in a flat plane, whereby operation of the adjusting means enables the straight line of thermal printing elements to be brought into parallel alignment with the platen axis, wherein the mounting means includes a stationary post, a mounting member for mounting the print head, wherein the mounting member includes a tubular portion having an elongate slot, and wherein the post is in guiding relation in the sot, and wherein the adjusting means includes a cam acting on the mounting member for enabling adjusting movement of the tubular portion along a flat plane.

11. Printing apparatus comprising: a thermal print head having thermal printing elements disposed in a straight line, a platen roll having an axis of rotation, means for mounting the print head for pivotal movement about a print head axis into and out of printing cooperation with the platen, means for adjusting the position of the print head axis, means for confining movement of the print head axis in a flat plane, whereby operation of the adjusting means enables the straight line of thermal printing elements to be brought into parallel alignment with the platen axis, wherein the mounting means includes a stationary post, a mounting member for mounting the print head, wherein the mounting member includes a tubular portion having an elongate slot, wherein the post is in guiding relation in the slot, wherein the adjusting means includes a cam acting on the mounting member for enabling adjusting movement of the tubular portion along a flat plane, wherein the cam comprises an eccentric, and wherein the tubular portion has a hole with a cam profile for receiving the eccentric.

* * * * *

UNITED STATES PATENT AND TRADEMARK OFFICE

CERTIFICATE OF CORRECTION

PATENT NO. : 4,957,379

DATED : September 18, 1990

INVENTOR(S) : Paul H. Hamisch, Jr. and David R. Wisecup

It is certified that error appears in the above-identified patent and that said Letters Patent is hereby corrected as shown below:

Column 5, line 9, after "position" a period --.-- should be added. Column 8, line 51, "206" should be --206'--; line 52, "206" should be --206'--. Column 9, line 29, after "129" there should be a period --.--. Column 12, line 33, "sot" should be --slot--.

Signed and Sealed this

Thirty-first Day of March, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,957,379

DATED : September 18, 1990

INVENTOR(S) : Paul H. Hamisch, Jr. and David R. Wisecup

It is certified that error appears in the above-identified patent and that said Letters Patent is hereby corrected as shown below:

ON TITLE PAGE:

References Cited, --West German 30 38 867-- should be added.

Signed and Sealed this

Fifteenth Day of September, 1992

*Attest:*

DOUGLAS B. COMER

*Attesting Officer*

*Acting Commissioner of Patents and Trademarks*